US011666196B2

(12) United States Patent
Luyckx et al.

(10) Patent No.: US 11,666,196 B2
(45) **Date of Patent: *Jun. 6, 2023**

(54) SURFACE CLEANING APPARATUS

(71) Applicant: BISSELL Inc., Grand Rapids, MI (US)

(72) Inventors: Michael Luyckx, Ada, MI (US); Jacob Resch, Grand Rapids, MI (US)

(73) Assignee: BISSELL Inc., Grand Rapids, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/524,000

(22) Filed: Nov. 11, 2021

(65) Prior Publication Data

US 2022/0061622 A1 Mar. 3, 2022

Related U.S. Application Data

(63) Continuation of application No. 17/221,282, filed on Apr. 2, 2021, now Pat. No. 11,185,205, which is a continuation of application No. 16/599,280, filed on Oct. 11, 2019, now Pat. No. 10,966,586, which is a continuation of application No. 15/827,790, filed on Nov. 30, 2017, now Pat. No. 10,512,383.

(51) Int. Cl.

| | |
|---|---|
| ***A47L 11/40*** | (2006.01) |
| ***A47L 9/16*** | (2006.01) |
| ***A47L 11/20*** | (2006.01) |
| ***A47L 7/00*** | (2006.01) |
| ***A47L 11/30*** | (2006.01) |

(52) U.S. Cl.

CPC ..... *A47L 11/4025* (2013.01); *A47L 7/0004* (2013.01); *A47L 9/16* (2013.01); *A47L 11/201* (2013.01); *A47L 11/305* (2013.01); *A47L 11/4016* (2013.01); *A47L 11/4027* (2013.01); *A47L 11/4083* (2013.01); *A47L 11/4088* (2013.01)

(58) Field of Classification Search

CPC ..... A47L 11/40; A47L 11/4083; A47L 9/16

See application file for complete search history.

(56) References Cited

U.S. PATENT DOCUMENTS

| | | | |
|---|---|---|---|
| 279,572 | A | 6/1883 | Leaycraft |
| 889,823 | A | 6/1908 | Spangler |
| 2,910,717 | A | 11/1959 | Raymond |

(Continued)

FOREIGN PATENT DOCUMENTS

| | | | |
|---|---|---|---|
| AU | 2016101847 | A4 | 11/2016 |
| KR | 20090132658 | A | 12/2009 |
| WO | 2016151607 | A1 | 9/2016 |

OTHER PUBLICATIONS

Claus Blumenberg, EP extended European Search Report for corresponding EP 18209065.4 dated Apr. 2, 2019.

(Continued)

*Primary Examiner* — Michael D Jennings

(74) *Attorney, Agent, or Firm* — Warner Norcross + Judd LLP

(57) ABSTRACT

A surface cleaning apparatus includes include at least a recovery system for removing the spent cleaning fluid and debris from the surface to be cleaned and storing the spent cleaning fluid and debris. The recovery system is provided with a recovery tank having a removably strainer that is configured to strain large debris and hair out of the recovery tank prior to emptying the recovery tank.

28 Claims, 6 Drawing Sheets

(56) References Cited

U.S. PATENT DOCUMENTS

| | | | | |
|---|---|---|---|---|
| 2,972,769 | A | 2/1961 | Keating | |
| 3,206,787 | A | 9/1965 | Daniels et al. | |
| 4,142,270 | A | 3/1979 | Nauta | |
| 4,349,434 | A | 9/1982 | Jaworski | |
| 4,458,377 | A | 7/1984 | Frohbieter | |
| 5,375,293 | A | 12/1994 | Gilbertson | |
| 5,735,017 | A | 4/1998 | Barnes | |
| 5,901,406 | A * | 5/1999 | Mueller | A47L 11/4088 15/353 |
| 6,131,237 | A * | 10/2000 | Kasper | A47L 5/30 15/320 |
| 6,134,744 | A * | 10/2000 | Kasen | A47L 11/03 15/328 |
| 6,231,647 | B1 * | 5/2001 | Cheng | A47L 5/24 96/108 |
| 7,159,271 | B2 * | 1/2007 | Sepke | A47L 11/34 15/320 |
| 7,942,156 | B2 | 5/2011 | Francisco et al. | |
| 2001/0047562 | A1 * | 12/2001 | Lenkiewicz | A47L 11/4075 15/320 |
| 2003/0226228 | A1 * | 12/2003 | Symensma | A47L 11/34 15/353 |
| 2007/0067945 | A1 * | 3/2007 | Kasper | A47L 9/181 15/328 |
| 2013/0111693 | A1 * | 5/2013 | Krondorfer | A47L 11/4083 15/320 |
| 2013/0318740 | A1 * | 12/2013 | DeJonge | A47L 7/0004 15/320 |
| 2014/0278599 | A1 * | 9/2014 | Reh | H04W 4/80 705/5 |
| 2014/0345079 | A1 * | 11/2014 | Johnson | A47L 11/4088 15/322 |
| 2017/0119225 | A1 * | 5/2017 | Xia | A47L 11/4044 |

OTHER PUBLICATIONS

H. Syer Cuming, "On Ancient Sieves and Colanders," Journal of the British Archeological Association, vol. 25, Issue 3, pp. 244-250 (1869).

Carroll Gantz, "The Vacuum Cleaner" (2012).

* cited by examiner

SURFACE CLEANING APPARATUS

CROSS REFERENCE TO RELATED APPLICATIONS

This application is a continuation of U.S. patent application Ser. No. 17/221,282, filed Apr. 2, 2021, now U.S. Pat. No. 11,185,205, issued Nov. 30, 2021, which is a continuation of U.S. patent application Ser. No. 16/599,280, filed Oct. 11, 2019, now U.S. Pat. No. 10,966,586, issued Apr. 6, 2021, which is a continuation of U.S. patent application Ser. No. 15/827,790, filed Nov. 30, 2017, now U.S. Pat. No. 10,512,383, issued Dec. 24, 2019, all of which are incorporated herein by reference in its their entirety.

BACKGROUND

Surface cleaning apparatus for cleaning floor surfaces sometimes include fluid recovery systems that extract fluid and debris (which may include dirt, dust, stains, soil, hair, and other debris) from the surface. The fluid recovery system typically includes a recovery tank, a nozzle adjacent the surface to be cleaned and in fluid communication with the recovery tank through a working air conduit, and a source of suction in fluid communication with the working air conduit to draw the cleaning fluid from the surface to be cleaned and through the nozzle and the working air conduit to the recovery tank. The recovery tank is periodically emptied of collected fluid and debris, such as by removing the recovery tank from the apparatus and pouring the collected fluid and debris into a sink, toilet, or other drain.

Some surface cleaning apparatus also include a fluid delivery system that delivers cleaning fluid to a surface to be cleaned. Multi-surface vacuum cleaners are adapted for cleaning hard floor surfaces such as tile and hardwood and soft floor surfaces such as carpet and upholstery, and can include fluid delivery and recovery systems. Other multi-surface cleaning apparatuses include "dry" vacuum cleaners which can clean different surface types, but do not dispense or recover fluid.

BRIEF DESCRIPTION

According to one aspect of the present disclosure, a surface cleaning apparatus, comprising a housing, and a recovery system, comprising a suction source, a suction nozzle in fluid communication with the suction source, and a recovery tank assembly including a recovery tank container having a bottom wall and a hollow standpipe extending from the bottom wall and a strainer assembly removably mounted within the recovery tank container and having a portion operably coupled to the hollow standpipe.

BRIEF DESCRIPTION OF THE DRAWINGS

The present disclosure will now be described with respect to the drawings in which.

DETAILED DESCRIPTION

The present disclosure generally relates to a surface cleaning apparatus. In particular, the present disclosure relates to an improved recovery tank and method for emptying a recovery tank.

According to one aspect of the present disclosure, a surface cleaning apparatus is provided with a recovery tank having a strainer configured to strain large debris and hair out of the recovery tank prior to emptying.

The functional systems of the surface cleaning apparatus can be arranged into any desired configuration, such as an upright device having a base and an upright body for directing the base across the surface to be cleaned, a canister device having a cleaning implement connected to a wheeled base by a vacuum hose, a portable device adapted to be hand carried by a user for cleaning relatively small areas, or a commercial device. Any of the aforementioned cleaners can be adapted to include a flexible vacuum hose, which can form a portion of the working air conduit between a nozzle and the suction source. The surface cleaning apparatus may specifically be in the form of a multi-surface wet vacuum cleaner. As used herein, the term "multi-surface wet vacuum cleaner" includes a vacuum cleaner that can be used to clean hard floor surfaces such as tile and hardwood and soft floor surfaces such as carpet.

The surface cleaning apparatus can include at least a recovery system for removing the spent cleaning fluid (e.g. liquid) and debris from the surface to be cleaned and storing the spent cleaning fluid and debris. The surface cleaning apparatus can optionally further include a fluid delivery system for storing cleaning fluid (e.g. liquid) and delivering the cleaning fluid to the surface to be cleaned. Aspects of the present disclosure may also be incorporated into a steam apparatus, such as surface cleaning apparatus with steam delivery. Aspects of the present disclosure may also be incorporated into an apparatus with only recovery capabilities, such as surface cleaning apparatus without fluid delivery.

Figure 1:
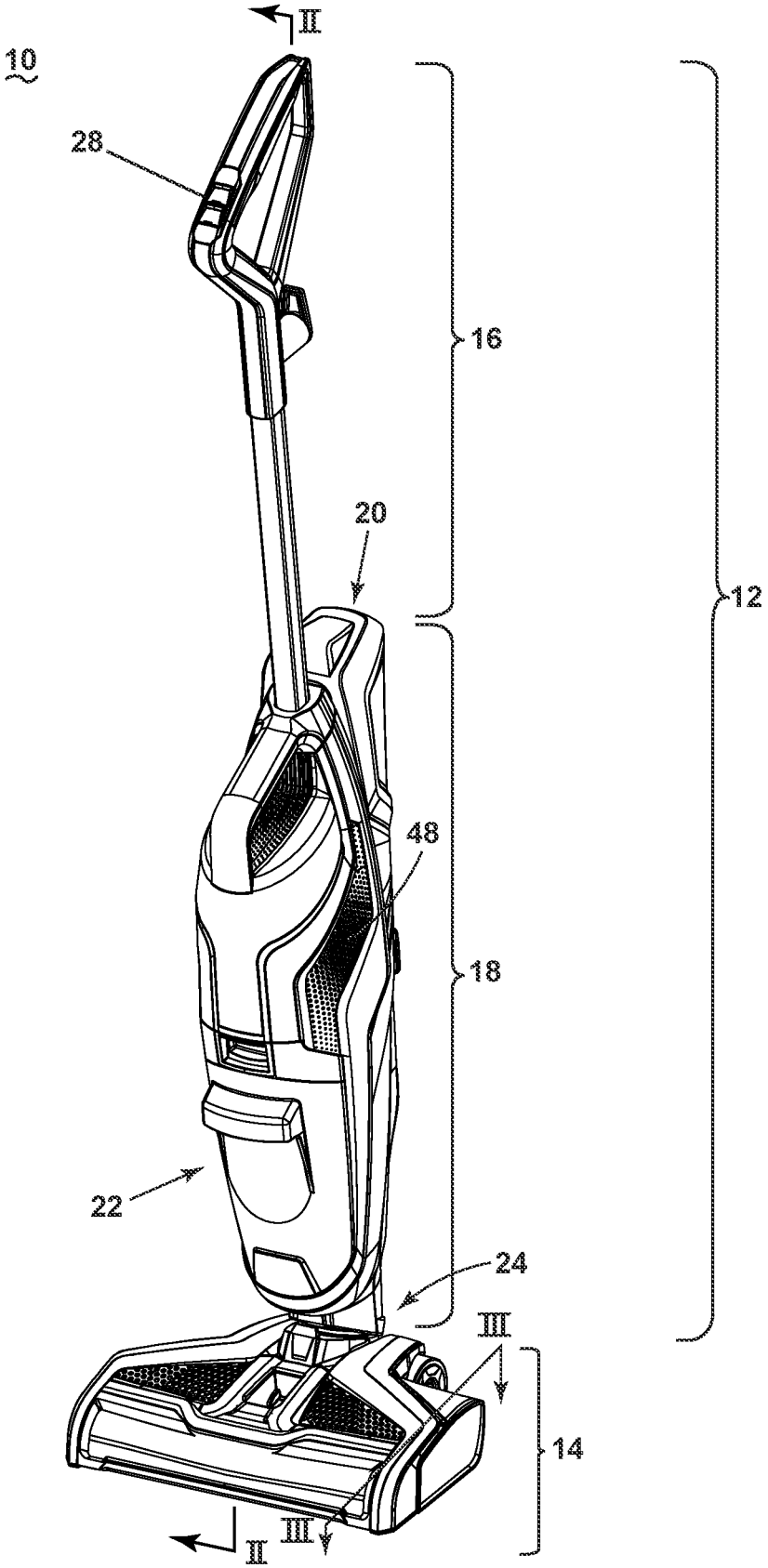
FIG. 1 is a perspective view of a surface cleaning apparatus according to one aspect of the present disclosure.

FIG. 1 is a perspective view of a surface cleaning apparatus 10 according to one embodiment of the present disclosure. As discussed in further detail below, the surface cleaning apparatus 10 is provided with a recovery tank having a strainer configured to strain large debris and hair out of the recovery tank prior to emptying. One example of a suitable surface cleaning apparatus in which the various features and improvements described herein can be used is disclosed in U.S. Patent Application Publication No. 2017/0119225, published May 4, 2017, now U.S. Pat. No. 10,092,155, which is incorporated herein by reference in its entirety.

As illustrated herein, the surface cleaning apparatus 10 is an upright multi-surface wet vacuum cleaner having a housing that includes an upright body or handle assembly 12 and a cleaning head or base 14 mounted to or coupled with the upright handle assembly 12 and adapted for movement across a surface to be cleaned. For purposes of description related to the figures, the terms "upper," "lower," "right," "left," "rear," "front," "vertical," "horizontal," "inner," "outer," and derivatives thereof shall relate to the present disclosure as oriented in FIG. 1 from the perspective of a user behind the surface cleaning apparatus 10, which defines the rear of the surface cleaning apparatus 10. However, it is to be understood that the present disclosure may assume various alternative orientations, except where expressly specified to the contrary.

The upright handle assembly 12 comprises an upper handle 16 and a frame 18. Frame 18 comprises a main support section or body assembly supporting at least a supply tank assembly 20 and a recovery tank assembly 22, and may further support additional components of the handle assembly 12. The surface cleaning apparatus 10 can include a fluid delivery or supply pathway, including and at least partially defined by the supply tank assembly 20, for storing cleaning fluid and delivering the cleaning fluid to the surface to be cleaned and a fluid recovery pathway, including and at least partially defined by the recovery tank assembly 22, for removing the spent cleaning fluid and debris from the surface to be cleaned and storing the spent cleaning fluid and debris until emptied by the user.

A movable joint assembly 24 can be formed at a lower end of the frame 18 and movably mounts the base 14 to the upright assembly 12. In the example shown herein, the base 14 can pivot up and down about at least one axis relative to the upright assembly 12. The joint assembly 24 can alternatively comprise a universal joint, such that the base 14 can pivot about at least two axes relative to the upright assembly 12. Wiring and/or conduits can optionally supplying air and/or liquid (or other fluids) between the base 14 and the upright assembly 12, or vice versa, can extend though the swivel joint assembly 24. A locking mechanism (not shown) can be provided to lock the joint assembly 24 against movement about at least one of the axes of the joint assembly 24.

Figure 2:
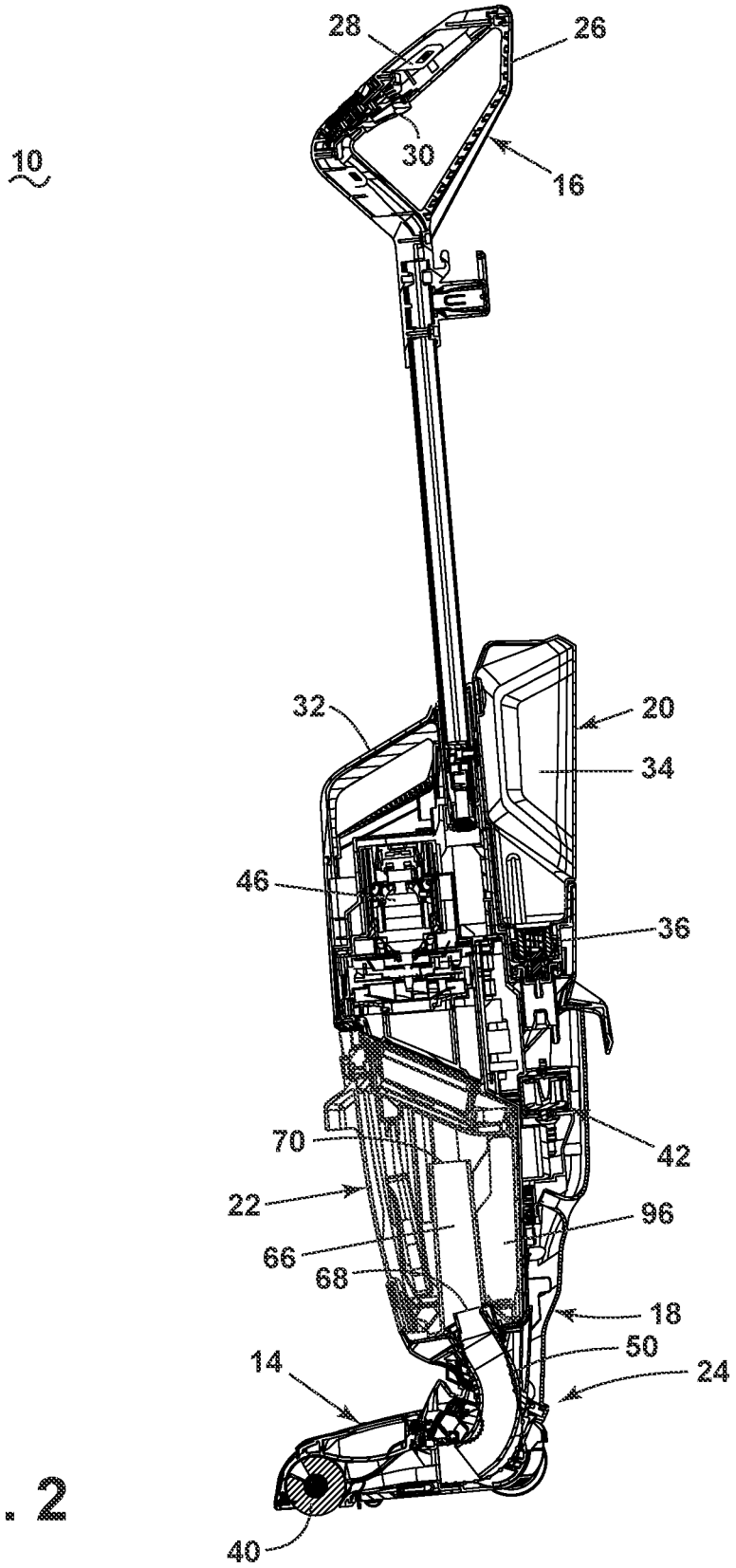
FIG. 2 is a cross-sectional view of the surface cleaning apparatus taken through line II-II of FIG. 1.

FIG. 2 is a cross-sectional view of the surface cleaning apparatus 10 through line II-II FIG. 1. The upper handle 16 can include a handgrip 26 and a user interface 28. In other examples, the user interface 28 can be provided elsewhere on the surface cleaning apparatus 10, such as on the frame 18. The user interface 28 can be electrically coupled with electrical components, including, but not limited to, a printed circuit board (PCB) and other required circuitry electrically connected to various components of the fluid delivery and recovery systems. The user interface 28 can be any configuration of actuating controls such as but not limited to buttons, triggers, toggles, switches, or the like, operably connected to systems in the apparatus 10 to affect and control function. In the present example, a trigger 30 is mounted to the handgrip 26 and operably communicates with the fluid delivery system to control fluid delivery from the surface cleaning apparatus 10. Other actuators, such as a thumb switch, can be provided instead of the trigger 30. A carry handle 32 can be disposed on the frame 18, forwardly of the handle 16, at an angle to facilitate manual lifting and carrying of the surface cleaning apparatus 10.

The supply tank assembly 20 can be mounted to the frame 18 in any configuration. In the present example, the supply tank assembly 20 is removably mounted to a housing of the frame 18 such that the supply tank assembly 20 partially rests in the upper rear portion of the frame 18 and can be removed for filling.

The recovery tank assembly 22 can be mounted to the frame 18 in any configuration. In the present example, the recovery tank assembly 22 is removably mounted to the front of the frame 18, below the supply tank assembly 20, and can be removed for emptying.

The fluid delivery system is configured to deliver cleaning fluid from the supply tank assembly 20 to a surface to be cleaned, and can include, as briefly discussed above, a fluid delivery or supply pathway. The cleaning fluid can comprise one or more of any suitable cleaning fluids, including, but not limited to, water, compositions, concentrated detergent, diluted detergent, etc., and mixtures thereof. For example, the fluid can comprise a mixture of water and concentrated detergent.

The supply tank assembly 20 includes at least one supply chamber 34 for holding cleaning fluid and a supply valve assembly 36 controlling fluid flow through an outlet of the supply chamber 34. Alternatively, supply tank assembly 20 can include multiple supply chambers, such as one chamber containing water and another chamber containing a cleaning agent.

For a removable supply tank assembly 20, the supply valve assembly 36 can mate with a receiving assembly on the frame 18 and can be configured to automatically open when the supply tank assembly 20 is seated on the frame 18 to release fluid to the fluid delivery pathway.

In addition to the supply tank assembly 20, the fluid delivery pathway can include a fluid distributor 38 (FIG. 3) having at least one outlet for applying the cleaning fluid to the surface to be cleaned. In one example, the fluid distributor 38 can be one or more spray tips on the base 14 configured to deliver cleaning fluid to the surface to be cleaned directly or indirectly by spraying a brushroll 40. Other examples of fluid distributors 38 are possible, such as a spray manifold having multiple outlets or a spray nozzle configured to spray cleaning fluid outwardly from the base 14 in front of the surface cleaning apparatus 10.

The fluid delivery system can further comprise a flow control system for controlling the flow of fluid from the supply tank assembly 20 to the fluid distributor 38. In one configuration, the flow control system can comprise a pump 42 which pressurizes the system. The trigger 30 can be operably coupled with the flow control system such that pressing the trigger 30 will delivery fluid from the fluid distributor 38. The pump 42 can be positioned within a housing of the frame 18, and in the illustrated example the pump 42 is beneath and in fluid communication with the supply tank assembly 20 via the valve assembly 36. In one example, the pump 42 can be a centrifugal pump. In another example, the pump 42 can be a solenoid pump having a single, dual, or variable speed.

In another configuration of the fluid supply pathway, the pump 42 can be eliminated and the flow control system can comprise a gravity-feed system having a valve fluidly coupled with an outlet of the supply tank assembly 20, whereby when valve is open, fluid will flow under the force of gravity to the fluid distributor 38.

Optionally, a heater (not shown) can be provided for heating the cleaning fluid prior to delivering the cleaning fluid to the surface to be cleaned. In one example, an in-line heater can be located downstream of the supply tank assembly 20, and upstream or downstream of the pump 42. Other types of heaters can also be used. In yet another example, the cleaning fluid can be heated using exhaust air from a motor-cooling pathway for a suction source of the recovery system.

The recovery system is configured to remove spent cleaning fluid and debris from the surface to be cleaned and store the spent cleaning fluid and debris on the surface cleaning apparatus 10 for later disposal, and can include, as briefly discussed above, a fluid recovery pathway. The fluid recovery pathway can include at least a dirty inlet and a clean outlet. The pathway can be formed by, among other elements, a suction nozzle 44 defining the dirty inlet, a suction source 46 in fluid communication with the suction nozzle 44 for generating a working air stream, the recovery tank assembly 22, and exhaust vents 48 (FIG. 1) defining the clean air outlet.

The suction nozzle 44 can be provided on the base 14 can be adapted to be adjacent the surface to be cleaned as the base 14 moves across a surface. The brushroll 40 can be provided adjacent to the suction nozzle 44 for agitating the surface to be cleaned so that the debris is more easily ingested into the suction nozzle 44. The suction nozzle 44 is further in fluid communication with the recovery tank assembly 22 through a flexible conduit 50. The flexible conduit 50 can pass through the joint assembly 24.

The suction source 46, which may be a motor/fan assembly 46, is provided in fluid communication with the recovery tank assembly 22. The motor/fan assembly 46 can be positioned within a housing of the frame 18, such as above the recovery tank assembly 22 and forwardly of the supply tank assembly 20. The recovery system can also be provided with one or more additional filters upstream or downstream of the motor/fan assembly 46.

Electrical components of the surface cleaning apparatus 10, including the motor/fan assembly 46, the pump 42, and a drive motor for the brushroll 40, can be electrically coupled to a power source (not shown), such as a battery or power cord plugged into a household outlet. The user interface 28 can include one or more switches for controlling actuation of the motor/fan assembly 46, the brushroll 40, and/or the pump 42. In one example, the user interface 28 can be provided with actuators for selecting between multiple cleaning modes. For instance, the surface cleaning apparatus 10 can have at least a hard floor cleaning mode and a carpet cleaning mode.

Figure 3:
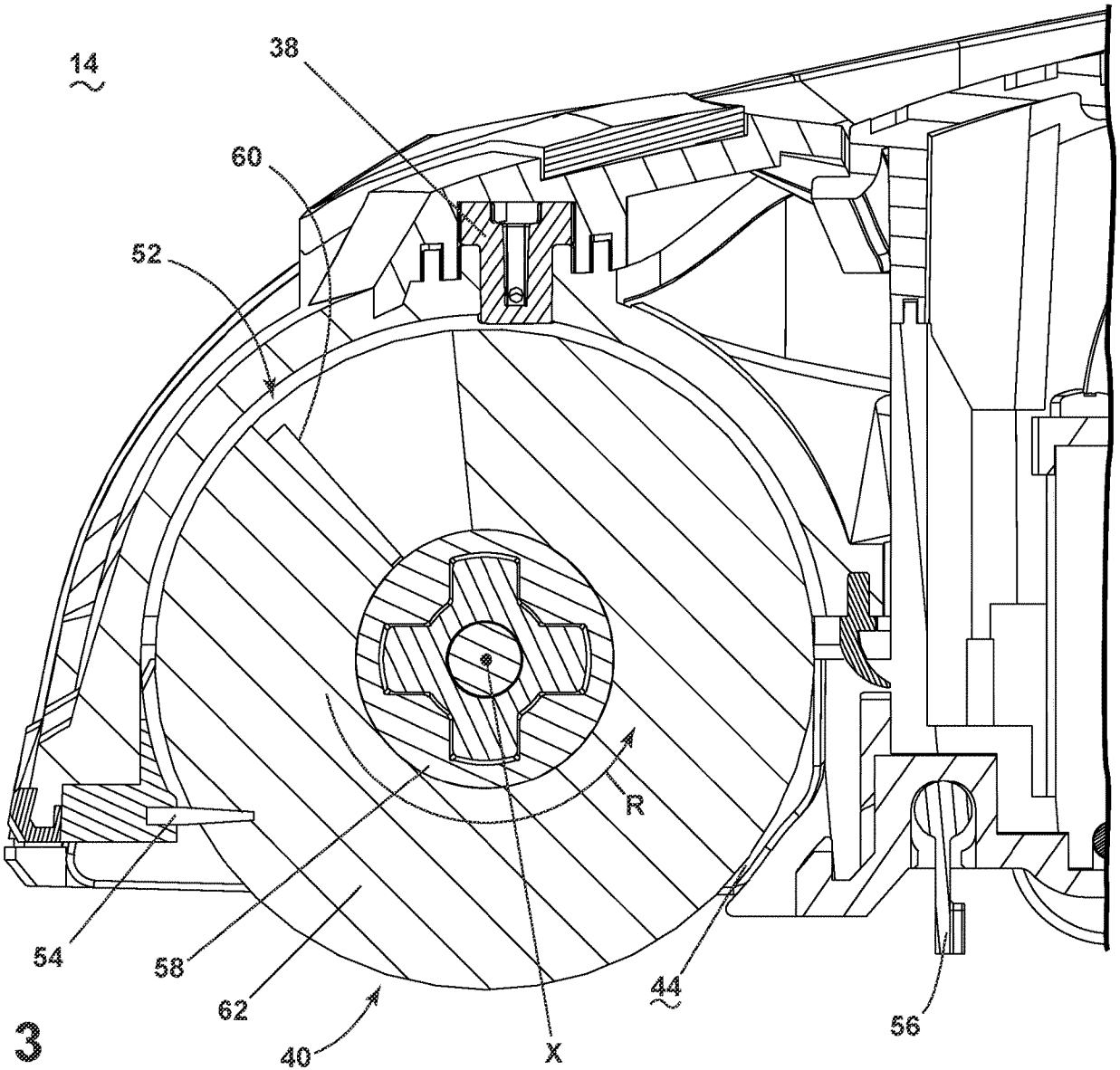
FIG. 3 is a sectional view through a portion a base of the surface cleaning apparatus taken through line III-III of FIG. 1.

FIG. 3 is a close-up sectional view through a forward section of the base 14. The brushroll 40 can be provided at a forward portion of the base 14 and received in a brush chamber 52 on the base 14. The brushroll 40 is positioned for rotational movement in a direction R about a central rotational axis X. The base 14 includes the suction nozzle 44 that is in fluid communication with the flexible conduit 50 (FIG. 2) and which is defined within the brush chamber 52. In the present example the suction nozzle 44 is configured to extract fluid and debris from the brushroll 40 and from the surface to be cleaned.

In the example, the brushroll 40 can be operably coupled to and driven by a drive assembly including a dedicated brush motor (not shown) in the base 14. Alternatively, the motor/fan assembly 46 can provide both vacuum suction and brushroll rotation.

The fluid distributor 38 of the present example includes multiple spray tips, though only one spray tip is visible in FIG. 3, which are mounted to the base 14 with an outlet in the brush chamber 52 and oriented to spray fluid inwardly onto the brushroll 40.

A front interference wiper 54 is mounted at a forward portion of the brush chamber 52 and is configured to interface with a leading portion of the brushroll 40, as defined by the direction of rotation R of the brushroll 40. The interference wiper 54 is below the fluid distributor 38, such that the wetted portion brushroll 40 rotates past the interference wiper 54, which scrapes excess fluid off the brushroll 40, before reaching the surface to be cleaned.

A rear squeegee 56 is mounted to the base 14 behind the brushroll 40 and the brush chamber 52 and is configured to contact the surface as the base 14 moves across the surface to be cleaned. The rear squeegee 56 wipes residual fluid from the surface to be cleaned so that it can be drawn into the fluid recovery pathway via the suction nozzle 44, thereby leaving a moisture and streak-free finish on the surface to be cleaned.

In the present example, brushroll 40 can be a hybrid brushroll suitable for use on both hard and soft surfaces, and for wet or dry vacuum cleaning. In one example, the brushroll 40 comprises a dowel 58, a plurality of bristles 60 extending from the dowel 58, and microfiber material 62 provided on the dowel 58 and arranged between the bristles 60. One example of a suitable hybrid brushroll is disclosed in U.S. Patent Application Publication No. 2017/0119225, now U.S. Pat. No. 10,092,155, incorporated above.

With reference to FIG. 2, in the illustrated example, the recovery tank assembly 22 comprises a recovery tank container 64, which forms the collection container for the fluid recovery system, with a hollow standpipe 66 therein. The standpipe 66 can be oriented such that it is generally coincident with a longitudinal axis of the tank container 64. The standpipe 66 forms a flow path between a tank inlet 68 formed at a lower end of the tank container 64 and a tank outlet 70 at the upper end of the standpipe 66 within the interior of the tank container 64. When the recovery tank assembly 22 is mounted to the frame 18 as shown in FIG. 2, the inlet 68 is aligned with the flexible conduit 50 to establish fluid communication between the base 14 and the recovery tank assembly 22. The standpipe 66 can be integrally formed with the tank container 64.

Figure 4:
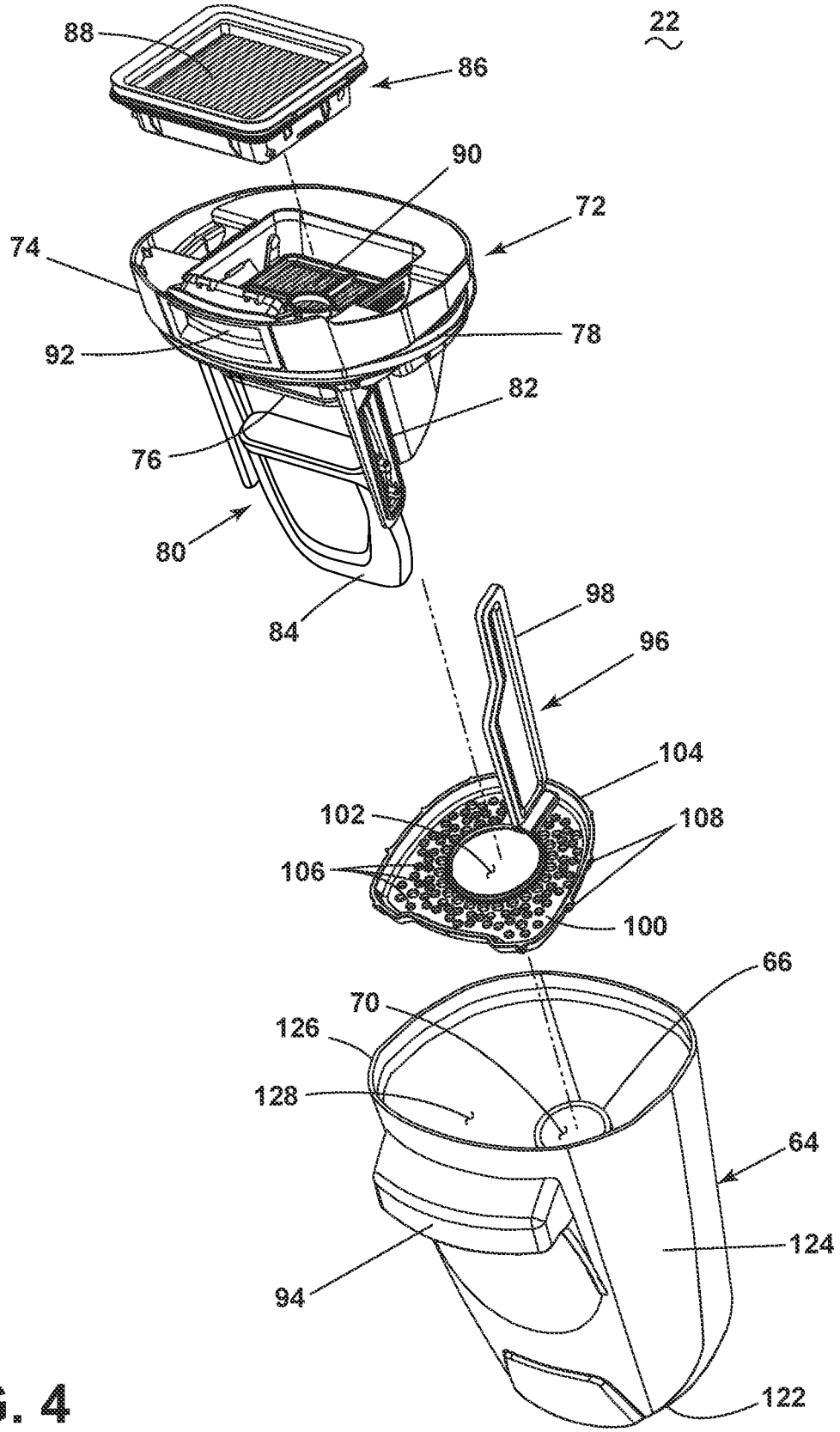
FIG. 4 is an exploded perspective view of a recovery tank assembly of the surface cleaning apparatus of FIG. 1.
Figure 6:
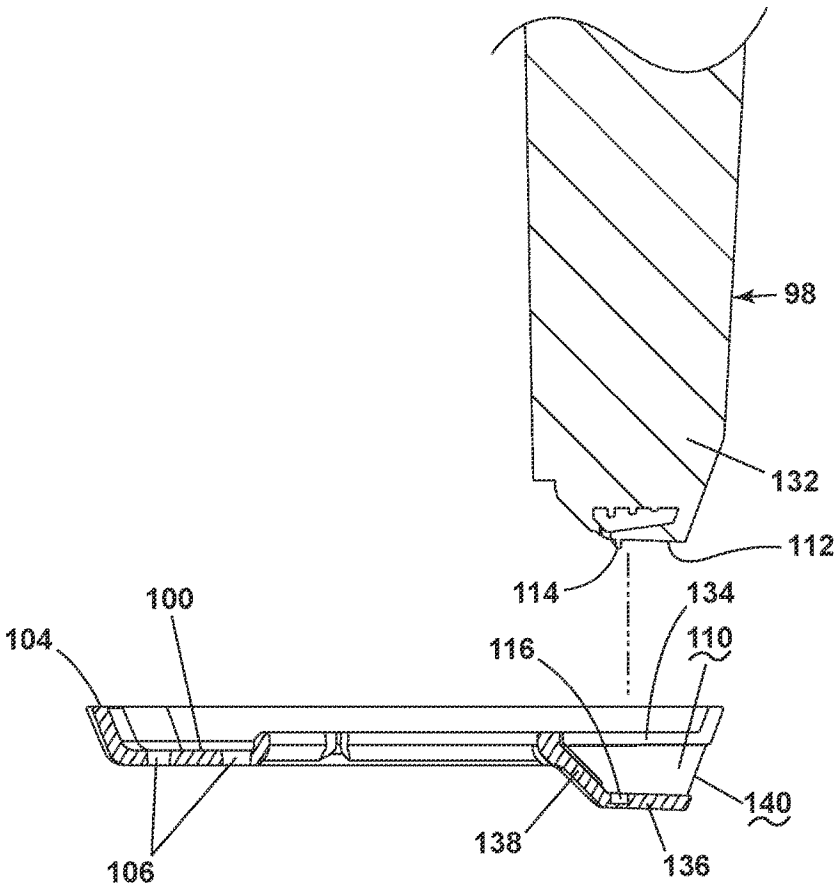
FIG. 6 is an exploded sectional view of the strainer of FIG. 5.
Figure 5:
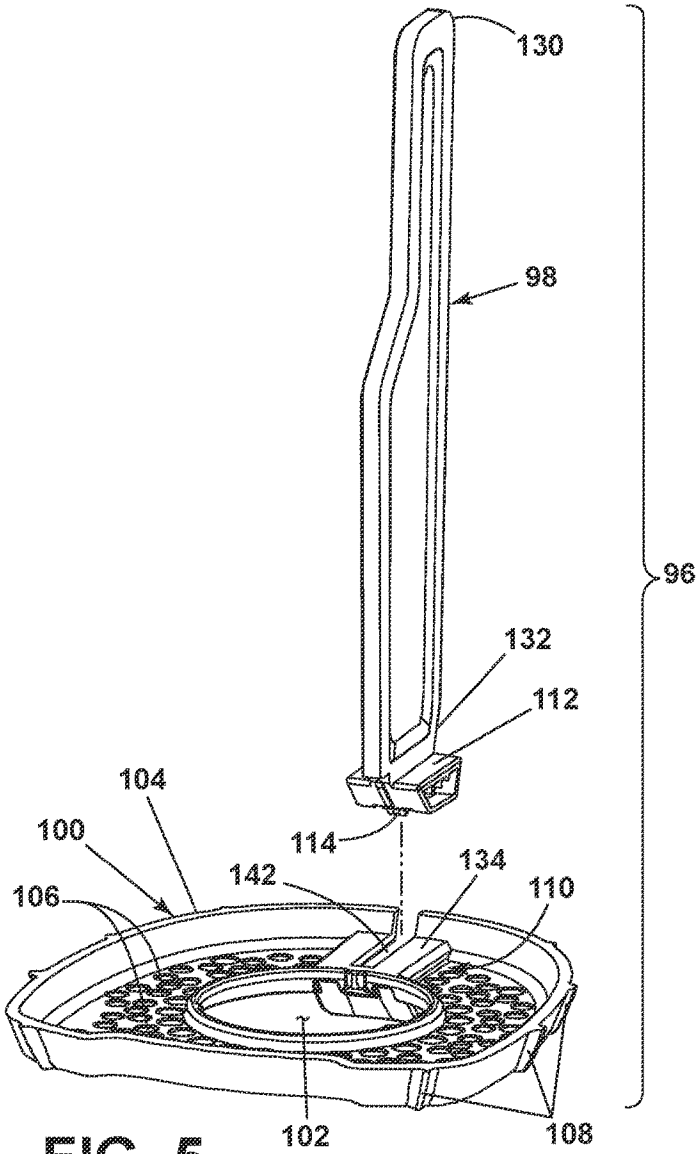
FIG. 5 is an exploded perspective view of a strainer for the recovery tank assembly of FIG. 4.

FIG. 4 is an exploded perspective view of the recovery tank assembly 22. The tank container 64 can generally have a bottom end and a top end opposite the bottom end. Particularly as shown herein, the tank container 64 can include a bottom wall 122 and an open top, with a peripheral side wall 124 extending between the bottom wall 122 and the open top, which can be defined by a top edge 126 of the side wall 124. Optionally, the standpipe 66 can be integrally formed with the tank container 64, such as being integrally formed with the bottom wall 122 and upwardly therefrom. The standpipe 66 can be located generally centrally within the tank container 64, with the space between the standpipe 66 and the bottom and side walls 122, 124 forming a collection chamber 128 for holding recovered debris and fluid.

The recovery tank assembly 22 further includes a lid assembly 72 sized for receipt on the tank container 64. The lid assembly 72 includes a cover 74 at least partially enclosing an open top of the tank container 64. The cover 74 or another portion of the lid assembly 72 can further define an air outlet 76 of the recovery tank assembly 22 leading to the downstream suction source 46. A gasket 78 is positioned between mating surfaces of the lid assembly 72 and the tank container 64 and creates a seal therebetween for prevention of leaks.

A shut-off valve can be provided with the recovery tank assembly 22 for interrupting suction when fluid in tank container 64 reaches a predetermined level. The shut-off valve can comprise a float assembly 80, which may be carried by the lid assembly 72. The float assembly 80 can include a float bracket 82 coupled with a bottom of the cover 74 in a position offset from the standpipe 66 and a movable float 84 carried by the float bracket 82. The float 84 is buoyant and oriented so that the top of the float 84 can selectively seal the air outlet 76 of the recovery tank assembly 22 when the fluid in the tank container 64 reaches a predetermined level.

The recovery tank assembly 22 can further include a filter assembly 86 provided between the interior of the tank container 64 and the air outlet 76, i.e. between the tank outlet 70 of the standpipe 66 and the air outlet 76. The filter assembly 86 can be supported by the lid assembly 72 and can include a pleated filter 88. In one example, the pleated filter 88 is made of a material that remains porous when wet. A mesh screen 90 can be carried by the cover 74 and can support the filter assembly 86 thereon.

A release latch 92 can be provided to facilitate removal of the recovery tank assembly 22 for emptying and/or cleaning, and can be positioned in an aperture on a front side of the lid assembly 72. The release latch 92 can include a latch button biased with spring (not shown) toward an engaged or latched position. The release latch 92 releasably engages with a portion of the housing of the frame 18 to removably secure the recovery tank assembly 22 to the frame 18. A hand grip 94 can be provided on the tank container 64 and located below the release latch 92 to facilitate handling of the recovery tank assembly 22.

The recovery tank assembly 22 can further include a removable strainer 96 configured to strain large debris and hair out of the tank container 64 prior to emptying. The strainer 96 is configured to collect the large debris and hair while draining fluid (e.g. liquid) and smaller debris back into the tank container 64. For purposes of this description, large debris are any debris with a maximum dimension, such as a length or diameter, of greater than or equal to 0.5 mm to 6 mm, and preferably 3 mm, whereas small debris are any debris having a maximum dimension, such as a length or diameter, of less than that of the larger debris. An example of a piece of large debris includes a strand of hair with a length greater than 3 mm. Examples of small debris include coffee grounds and crumbs with diameters less than 3 mm.

The strainer 96 can comprises an elongated handle or grip 98 and a base 100. The tank container 64 can generally have a bottom end and a top end opposite the bottom end, and the strainer 96 can be removably mounted within the tank container 64 such that the base 100 is at the bottom end of the tank container 64 and the grip 98 extends toward the top end of the tank container 64.

The base 100 can include an opening, shown herein as a central hole 102, for accommodating the standpipe 66 of the tank container 64, a raised rim 104 around its perimeter for containing debris, and a plurality of drain holes 106 inward of the rim 104 for draining fluid when the strainer 96 is removed from the tank container 64. The flat-bottomed base 100 with raised rim 104 form a cup-shaped colander that retains large debris and hair. The standpipe 66 passes through the base 100 via the opening or central hole 102.

The drain holes 106 shown herein are circular openings or apertures through the planar surface of the base 100. In one example, the diameter of the drain holes 106 ranges from 3 mm-4 mm, such that fluid and debris having a diameter of less than 3 mm-4 mm drain through the drain holes 106 while debris larger than 3 mm-4 mm is captured by the strainer 96 when it is removed from the tank container 64. Other examples of drain holes 106 are possible, including non-circular openings or apertures through the planar surface of the base 100. Still further, other examples of the strainer 96 can have a grid or mesh on the base 100 defining the drain holes 106. In other examples, the size of the drain holes 106 can range in diameter from 0.5 mm to 6 mm.

The base 100 can be configured to fit within the tank container 64 at a location spaced from the bottom wall 122 of the tank container 64. When the strainer 96 is inserted into the tank container 64, fluid and small debris can pass through the drain holes 106 to the area of the collection chamber 128 below the base 100, while large debris and hair is trapped above the base 100.

Optionally spacer ribs 108 on the outboard surface of the rim 104 are configured to space the rim 104 away from an inner surface of the tank container 64, such as the inner surface of the side wall 124, to prevent fine debris, such as sand, or sticky residue from causing the strainer 96 to become stuck within the tank container 64. The space ribs 108 can also help limit the insertion of the strainer 96 into the tank container 64 to maintain the base 100 spaced above the bottom wall 122 of the tank container 64. As shown, in one example, the spacer ribs 108 can be oriented vertically or elongated in the insertion direction of the strainer 96. Other configurations for the spacer ribs 108 are possible, as long as the spacer ribs 108 prevent fine debris, such as sand, or sticky residue from causing the strainer 96 to become stuck within the tank container 64.

The grip 98 extends upwardly from the base 100 and can be elongated such that the base 100 can reside near the bottom of the tank container 64 while still allowing the user to easily access the grip 98 to selectively remove the strainer 96. An upper or handle end 130 of the grip 98 is accessible from the open top of the tank container 64 when the lid assembly 72 is removed from the tank container 64, and can be gripped by a user by reaching into the collection chamber 128. In other examples, a portion of the grip 98 can protrude outwardly from the tank container 64 to be gripped by a user when the lid assembly 72 is removed.

As shown, the grip 98 can extends upwardly and/or vertically along the inner surface of the side wall 124 of the tank container 64, and can be a one-piece or single upright handle. The grip 98 can be oriented such that it is generally parallel to the longitudinal axis of the tank container 64, and optionally also to the standpipe. The strainer 96 shown herein is further inserted and removed from the tank container 64 along a direction that is parallel to, or coincident with, the longitudinal axis of the tank container 64.

The base 100 extends from a lower end 132 of the grip 98 to substantially cover the bottom wall 122 of the tank container 64, such that any large debris/hair is trapped by the base 100 above the bottom wall 122. The grip 98 can be provided at one side of or at the perimeter of the base 100, with the base 100 extending generally laterally or horizontally relative to a lifting axis defined along the grip 98. The offset grip 98 provides a larger surface area of the base 100 to be dedicated to the drain holes 106, and also allows clearance for the central hole 102 to receive the standpipe 66. The grip 98 can also be relative slender to maximize space available for collecting debris and fluid.

Optionally, the grip 98 and the base 100 are joined by a press-fit connection, which may include a pocket 110, such as a T-slot pocket, in the base 100 and a connector 112, such as a T-shaped connector, with a retainer hook 114 on a lower portion of the grip 98. The pocket 110 includes a blind detent recess 116 for the retainer hook 114. The connector 112 can be inserted into the pocket 110 to form a robust 'one-time' press-fit connection. Other types of connections between the grip 98 and the base 100 are possible, including integrally forming the grip 98 with the base 100 or using an adhesive to join the grip 98 with the base 100.

The pocket 110 as illustrated comprises an open-ended receptacle, and is defined at least by spaced upper and lower pocket walls 134, 136 and an inner pocket wall 138 joining the upper and lower pocket walls 134, 136 opposite an open end 140 of the pocket 110. The upper pocket wall 134 has a slot 142 therein which is open to the open end 140 of the pocket 110 for projection of the lower end 132 of the grip 98 therethrough when the grip 98 is joined with the base 100. The lower pocket wall 136 can include the blind detent recess 116 for the retainer hook 114. The inner pocket wall 138 can defines how far the connector 112 can be inserted laterally into the pocket 110.

The surface cleaning apparatus 10 shown in the figures can be used to effectively remove debris and fluid from the surface to be cleaned in accordance with the following method. The sequence of steps discussed is for illustrative purposes only and is not meant to limit the method in any way as it is understood that the steps may proceed in a different logical order, additional or intervening steps may be included, or described steps may be divided into multiple steps, without detracting from the present disclosure.

In operation, the surface cleaning apparatus 10 is prepared for use by connection to the power source and by filling the supply tank assembly 20 with cleaning fluid. Operational selections can be made through the user interface 28. Cleaning fluid is selectively delivered to the surface to be cleaned via the fluid supply pathway by user-activation of the trigger 30, while the surface cleaning apparatus 10 is moved back and forth over the surface. Cleaning fluid is released through the fluid distributor 38 and onto the brushroll 40 or directly onto the surface to be cleaned.

The brushroll 40 can be wiped across the surface to be cleaned to remove debris and fluid present on the surface. Simultaneously, fluid and debris can be drawn into the suction nozzle 44 and the fluid recovery pathway when the motor/fan assembly 46 is activated. Additionally, cleaning fluid and debris can be scraped by the rear squeegee 56 and drawn into the fluid recovery pathway. Optionally, during operation of the brushroll 40, the suction motor/fan assembly 46 can be inoperative, which facilitates a wet scrubbing mode so that the soiled cleaning solution is not removed as the apparatus 10 is moved back and forth across the surface to be cleaned.

During operation of the fluid recovery pathway, fluid and debris-laden working air passes through the suction nozzle 44 and into the downstream recovery tank assembly 22 where the fluid and debris are substantially separated from the working air. The airstream then passes through the suction motor/fan assembly 46 prior to being exhausted through the vents 48.

Figure 8:
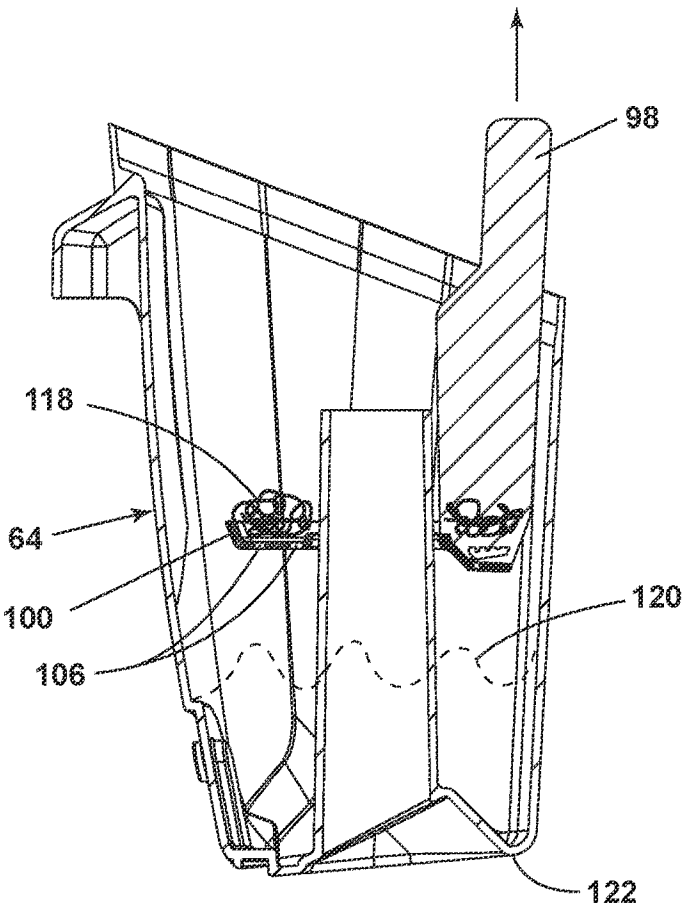
FIG. 8 is a sectional view similar to FIG. 7, showing the recovery tank assembly with a lid assembly removed and the strainer being lifted to strain out large debris and hair from the fluid and debris collected in the recovery tank assembly.
Figure 7:
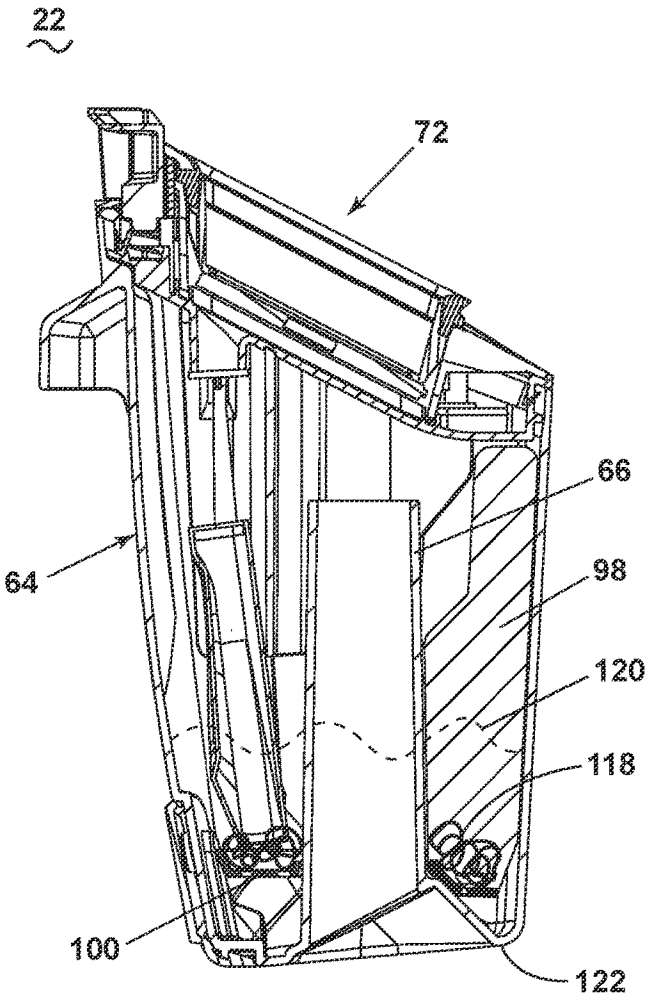
FIG. 7 is a sectional view through the recovery tank assembly taken through line II-II of FIG. 1, showing fluid and debris collected in the recovery tank assembly.

With reference to FIGS. 7-8, the recovery tank assembly 22 can be periodically emptied of collected fluid and debris by removing the recovery tank assembly 22 from the frame 18. When the recovery tank assembly 22 is ready to be emptied, a user removes the recovery tank assembly 22 from the frame 18 and removes the lid assembly 72, including the float and filter assemblies 80, 86 attached thereto, from the tank container 64. Next, a user grasps an upper portion of the grip 98 and lifts the strainer base 100 out of the tank container 64. As the base 100 is lifted upwardly, large debris and hair, collectively indicated by reference numeral 118, is captured on the top surface while fluid and smaller debris, collectively indicated by reference numeral 120, is allowed to drain through the drain holes 106. The user can then dispose of any debris 118 on the strainer 96 in the trash, and then dispose of the remaining fluid 120 in the tank container 64 in a sink, toilet, or other drain.

In typical recovery tanks, large debris and hair is not strained out and is disposed of together with the fluid waste (e.g. liquid waste), which can potentially result in clogged drains and pipes. Alternatively, large debris and hair can be manually picked out of the recovery tank, which is unsanitary and laborious. With the strainer 96 according to the example of the present disclosure disclosed herein, a user can simply remove the lid assembly 72, which also removes the float assembly 80, and then lift the strainer 96 out of the tank container 64 by the elongated grip 98. The strainer 96 separates out large debris and hair while fluid and smaller debris drains through the holes 106 back into the tank container 64. The long grip 98 prevents a user from contact with any of the collected debris or fluid. Thus, a user can easily and sanitarily dispose of any large debris and hair in the trash, prior to emptying the fluid waste down a sink, toilet, or other drain thereby avoiding the problems with prior recovery tanks.

The strainer 96 is particularly helpful for use with a multi-surface vacuum cleaner because these types of vacuum cleaners ingest wet and dry debris, including large dry debris, and deposit the debris mixture into a single recovery tank. This debris mixture can potentially clog drains and pipes. This also differs from a conventional carpet deep cleaner, which is only capable of ingesting liquid and small debris due to the comparatively small size of the extraction suction nozzle—the depth of the nozzle opening prevents large debris from being ingested and deposited into the recovery tank. Thus, because the debris mixture recovered by a multi-surface cleaner can contain larger debris than the mixture recovered by a conventional carpet deep cleaner, the strainer can be particularly helpful for separating large debris from the mixture prior to emptying waste liquid and small debris down a sink, toilet or other drain, and thereby preventing risk of clogged drains and pipes.

To the extent not already described, the different features and structures of the various examples of the present disclosure, may be used in combination with each other as desired, or may be used separately. That one surface cleaning apparatus is illustrated herein as having all of these features does not mean that all of these features must be used in combination, but rather done so here for brevity of description. Furthermore, while the surface cleaning apparatus 10 shown herein has an upright configuration, the surface cleaning apparatus can be configured as a canister or portable unit. For example, in a canister arrangement, foot components such as the suction nozzle and brushroll can be provided on a cleaning head coupled with a canister unit. Still further, the surface cleaning apparatus can additionally have steam delivery capability. Thus, the various features of the different examples may be mixed and matched in various vacuum cleaner configurations as desired to form new examples, whether or not the new examples are expressly described.

While the present disclosure has been specifically described in connection with certain specific embodiments thereof, it is to be understood that this is by way of illustration and not of limitation. Reasonable variation and modification are possible with the scope of the foregoing disclosure and drawings without departing from the spirit of the invention which, is defined in the appended claims. Hence, specific dimensions and other physical characteristics relating to the embodiments disclosed herein are not to be considered as limiting, unless the claims expressly state otherwise.

What is claimed is:

1. A surface cleaning apparatus, comprising:

a housing; and a recovery system, comprising:

a suction source;

a suction nozzle in fluid communication with the suction source; and a recovery tank assembly including a recovery tank container having a bottom wall and a hollow standpipe extending from the bottom wall and a strainer assembly removably mounted within the recovery tank container and having a portion operably coupled to the hollow standpipe.

2. The surface cleaning apparatus of claim 1, wherein at least a portion of the strainer assembly is cup shaped.

3. The surface cleaning apparatus of claim 2, wherein the strainer assembly further comprises an interior portion, which is operably coupled along at least a portion of the hollow standpipe.

4. The surface cleaning apparatus of claim 3, wherein the interior portion is centralized.

5. The surface cleaning apparatus of claim 3, wherein the interior portion comprises an aperture configured to receive the hollow standpipe.

6. The surface cleaning apparatus of claim 2, wherein at least a portion of the strainer assembly includes a plurality of apertures.

7. The surface cleaning apparatus of claim 6, wherein the at least a portion of the strainer assembly includes a mesh defining the plurality of apertures.

8. The surface cleaning apparatus of claim 2, wherein the strainer assembly is removably mounted within the recovery tank container at a location spaced from the bottom wall.

9. The surface cleaning apparatus of claim 2, wherein at least a portion of the strainer assembly is removably mounted along at least a portion of the hollow standpipe.

10. The surface cleaning apparatus of claim 1, wherein the strainer assembly further includes a flat-bottomed base.

11. The surface cleaning apparatus of claim 10, wherein the strainer assembly further comprises at least one aperture located along a portion of the flat-bottomed base.

12. The surface cleaning apparatus of claim 11, wherein the at least one aperture receives the hollow standpipe.

13. The surface cleaning apparatus of claim 11, wherein the flat-bottomed base is included in a cup shaped strainer.

14. The surface cleaning apparatus of claim 1, wherein the recovery tank container comprises a side wall extending from the bottom wall toward an open top of the recovery tank container and wherein the strainer assembly is spaced from the bottom wall of the recovery tank container.

15. The surface cleaning apparatus of claim 14, wherein the hollow standpipe is integrally formed with the recovery tank container, the hollow standpipe defining an inlet to the recovery tank container.

16. The surface cleaning apparatus of claim 1, wherein the portion includes an opening adapted to accommodate the hollow standpipe.

17. The surface cleaning apparatus of claim 16, wherein the opening is adapted to accommodate a width of the hollow standpipe.

18. The surface cleaning apparatus of claim 1, wherein the recovery tank assembly further comprises a removable lid assembly at least partially enclosing an open top of the recovery tank container and defining an air outlet of the recovery tank container in fluid communication with the suction source.

19. The surface cleaning apparatus of claim 18, wherein the recovery tank container comprises a filter assembly provided fluidly upstream of the air outlet and wherein the filter assembly is carried by and removable with the removable lid assembly.

20. The surface cleaning apparatus of claim 1, wherein the recovery tank container is removably mounted on the housing.

21. The surface cleaning apparatus of claim 1, comprising a collection chamber defined by an interior side of the recovery tank container and an exterior side of the standpipe, wherein the strainer assembly divides the collection chamber into an upper area and a lower area, wherein the lower area is closed to an interior of the standpipe, such that liquid must pass through the strainer assembly to reach the lower area of the collection chamber.

22. The surface cleaning apparatus of claim 21, wherein the strainer assembly comprises a base with a plurality of drain holes, wherein a diameter of the drain holes is 0.5 mm to 6 mm.

23. The surface cleaning apparatus of claim 21, wherein the strainer assembly comprises a base with a plurality of drain holes, wherein a diameter of the drain holes is 3 mm to 4 mm.

24. The surface cleaning apparatus of claim 1, wherein the strainer assembly comprises a base with a plurality of drain holes, a central hole to accommodate the standpipe, a raised rim around a perimeter of the base, and a plurality of spacer ribs on an outboard surface of the rim to space the rim away from an inner surface of the recovery tank container.

25. The surface cleaning apparatus of claim 1, wherein the strainer assembly comprises a base with a plurality of drain holes and a handle coupled with the base, wherein the handle is offset from the standpipe.

26. The surface cleaning apparatus of claim 1, wherein the recovery tank assembly comprises a hand grip and the strainer assembly comprises a handle, wherein the hand grip is disposed on a forward exterior side of the recovery tank container and the handle is disposed at a rearward side of the recovery tank container.

27. The surface cleaning apparatus of claim 1, wherein:

the recovery tank container comprises a side wall extending from the bottom wall, the side wall having a top edge defining an open top of the recovery tank container;

the strainer assembly comprises a base with a plurality of drain holes; and wherein the strainer assembly is removably mounted within the recovery tank container in a position where the base is closer to the bottom wall of the recovery tank container than the open top of the recovery tank container.

28. The surface cleaning apparatus of claim 1, wherein the standpipe is tapered and defines an outer diameter that decreases in a direction extending away from the bottom wall of the recovery tank container, and the strainer assembly comprises an interior portion defining an inner diameter of the strainer assembly, wherein the inner diameter of the strainer assembly abuts the outer diameter of the standpipe proximate the bottom wall of the recovery tank container.

* * * * *